US007594991B2

(12) United States Patent
Hantzer et al.

(10) Patent No.: US 7,594,991 B2
(45) Date of Patent: Sep. 29, 2009

(54) ALL CATALYTIC MEDICINAL WHITE OIL PRODUCTION

(75) Inventors: Sylvain S. Hantzer, Purcellville, VA (US); Eric D. Joseck, Burke, VA (US); Timothy L. Hilbert, Fairfax, VA (US); Evelino A. Ruibal, Morristown, NJ (US); Jean-Philippe L. Andre, Oakton, VA (US); Thomas R. Palmer, Bethlehem, PA (US); Michael B. Carroll, Center Valley, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 12/005,897

(22) Filed: Dec. 28, 2007

(65) Prior Publication Data

US 2009/0166251 A1 Jul. 2, 2009

(51) Int. Cl.
*C10G 47/00* (2006.01)

(52) U.S. Cl. ..... 208/58; 208/18; 208/89; 585/13; 585/734; 585/737; 585/738

(58) Field of Classification Search ..... 208/58, 208/57, 89, 18; 585/734, 737, 738, 13
See application file for complete search history.

(56) References Cited

U.S. PATENT DOCUMENTS

| | | | | |
|---|---|---|---|---|
| 3,629,096 | A | 12/1971 | Divijak, Jr. | |
| 3,759,817 | A | 9/1973 | Mills et al. | |
| 3,801,496 | A | 4/1974 | Benner | |
| 4,072,603 | A | 2/1978 | Wentzheimer | |
| 4,086,184 | A | 4/1978 | Henry et al. | |
| 4,183,801 | A | 1/1980 | Breuker et al. | |
| 4,263,127 | A | 4/1981 | Rausch et al. | |
| 4,961,836 | A | 10/1990 | Murphy | |
| 5,453,176 | A | 9/1995 | Narloch et al. | |
| 6,245,221 | B1 | 6/2001 | Baird et al. | |
| 6,723,229 | B2 | 4/2004 | Hantzer et al. | |
| 7,077,947 | B2 * | 7/2006 | Cody et al. | 208/89 |
| 2003/0062292 | A1 * | 4/2003 | Hantzer et al. | 208/210 |
| 2006/0016724 | A1 | 1/2006 | Miller et al. | |

FOREIGN PATENT DOCUMENTS

| | | | |
|---|---|---|---|
| FR | 2142583 | A | 2/1973 |
| FR | 2405290 | | 5/1979 |
| JP | 03115490 | A | 5/1991 |
| WO | WO 97/21788 | A1 | 6/1997 |
| WO | WO 00/42128 | A1 | 1/2000 |
| WO | WO 00/27950 | A1 | 5/2000 |
| WO | WO 01/81508 | A1 | 11/2001 |

* cited by examiner

*Primary Examiner*—Glenn A Caldarola
*Assistant Examiner*—Pamela Weiss
(74) *Attorney, Agent, or Firm*—Robert A. Migliorini

(57) ABSTRACT

All catalytic process for producing white oils is provided. More particularly, medicinal grade white oils are produced from a process including hydrotreating and/or hydrocracking, catalytic dewaxing followed by hydrofinishing to produce a medicinal white oil.

4 Claims, 8 Drawing Sheets

ALL CATALYTIC MEDICINAL WHITE OIL PRODUCTION

FIELD OF THE INVENTION

This invention relates to an all catalytic process for producing white oils. More particularly, medicinal grade white oils are produced from a process including hydrotreating and/or hydrocracking, catalytic dewaxing followed by hydrofinishing to produce a medicinal white oil.

BACKGROUND OF THE INVENTION

White mineral oils, also called white oils, are colorless, transparent, oily liquids obtained by the refining of crude petroleum feedstocks. In the production of white oils, an appropriate petroleum feedstock is refined to eliminate, as completely as possible, oxygen, nitrogen, and sulfur compounds, reactive hydrocarbons including aromatics, and any other impurity which would prevent use of the resulting white oil in the pharmaceutical or food industry. White oils generally fall into two classes, technical grade and medicinal grade. Technical grade white oils are those suitable for use in cosmetics, textile lubrication, bases for insecticides, and the like. The more highly refined medicinal grade white oils are those suitable for use in drug compositions, foods, and for the lubrication of food handling machinery. The medicinal grade white oils must be chemically inert and substantially without color, odor, or taste. Also, for these applications manufacturers must remove "readily carbonizable substances" (RCS) from the white oil. RCS are impurities that cause the white oil to change color when treated with strong acid. The Food and Drug Administration (FDA) and white oil manufacturers have stringent standards with respect to RCS, which must be met before the white oil can be marketed for use in food or medicinal applications. In particular, the. Code of Federal Regulations, 21 C.F.R. §172.878(1988) defines white mineral oil as a mixture of liquid hydrocarbons, essentially paraffinic in nature obtained from petroleum and refined to meet the test requirements of the *United States Pharmacopoeia XX*, pp. 532 (1980) for readily carbonizable substances and for sulfur compounds. The Ultraviolet Absorption Test generally measures the ultraviolet absorbance of an extract in the range of 260-350 nm, which absorbance is then compared with that of a naphthalene standard. This test sets forth limits for the presence of polynuclear compound impurities in the white oil.

White oil must also pass the Hot Acid Carbonizable Substances Test (ASTM D-565) to conform to the standard of quality required for pharmaceutical use. In order to pass this test the oil layer must show no change in color and the acid level is not darker than that of the reference standard colorimetric solution. From this test it will be seen that for purposes of interpreting test results, the art has recognized that a value of 16 or below on a standard test, the Hellige Amber C Color Wheel, is sufficient to pass the carbonizable substances test.

Medicinal grade white oils have a Saybolt color by ASTM D156-02 greater than +20 and have a low UV absorbance as defined in 21 CFR 178.3620. Medicinal white oils must also meet the requirements of 21 CFR 172.878.

Medicinal white oils are high value oils but are expensive to produce since they require a number of process steps which may include hydrocracking, hydrotreating, hydrofinishing and treating by an adsorbent or a solvent. An example of four stage catalytic process to make pharmaceutical white oils is U.S. Pat. No. 6,723,229. US published application 20060016724 relates to a process for producing white oils using a selective hydroisomerization catalyst.

There is an incentive to produce oils which meet medicinal white oil specifications at lower processing cost. What is desired are catalytic processes that produce medicinal white oils with minimal manufacturing costs and produce a separate medicinal white oil product not contaminated with other products including other grades of white oils.

SUMMARY OF THE INVENTION

This invention relates to an all catalytic process for making medicinal grade white oils which comprises:

(a) hydrotreating a hydrocarbon feedstock under hydrotreating conditions to produce a first hydrotreated feedstock;

(b) separating ammonia and hydrogen sulfide from the first hydrotreated feedstock;

(c) hydrotreating stripped hydrotreated feedstock from step (b) under hydrotreating conditions to produce a second hydrotreated feedstock;

(d) dewaxing the second hydrotreated feedstock from step (c) using a hydroisomerizing dewaxing catalyst under dewaxing conditions to produce a dewaxed feedstock, (e) fractionating the dewaxed product from step (d) to separate any ammonia, hydrogen sulfide and light ends from the dewaxed feedstock, and (f) hydrofinishing the dewaxed feedstock from step (e) under hydrofinishing conditions including MCM-41 as hydrofinishing catalyst to produce a hydrofinished medicinal white oil product, and (g) adjusting conditions in at least one of step (a), step (c), step (d) or step (f) as required to produce a hydrofinished medicinal white oil product that has a naphthenic carbon to paraffinic carbon ratio in the range 0.45 to 0.65.

Another embodiment relates to an all catalytic process for making medicinal grade white oils which comprises:

(a) hydrotreating a hydrocarbon feedstock under hydrotreating conditions to produce a hydrotreated feedstock;

(b) hydrocracking the hydrotreated feedstock under hydrocracking conditions to produce a hydrocracked feedstock, (c) separating ammonia and hydrogen sulfide contaminants from the hydrocracked feedstock, (d) dewaxing the hydrocracked feedstock from step (c) using a hydroisomerizing dewaxing catalyst under dewaxing conditions to produce a dewaxed feedstock, (e) hydrofinishing the dewaxed feedstock from step (d) under first hydrofinishing conditions to produce a first hydrofinished product (f) fractionating the first hydrofinished product from step (e) to separate a light ends overhead, a first medicinal white oil and a base oil plus technical white oil, (g) hydrofinishing the first medicinal white oil from step (f) under second hydrofinishing conditions including MCM-41 as hydrofinishing catalyst to produce a hydrofinished medicinal white oil, and (h) adjusting conditions in at least one of step (a), step (b), step (d), step (e) or step (g) as required to produce a hydrofinished medicinal white oil that has a naphthenic carbon to paraffinic carbon ratio in the range 0.45 to 0.65.

Yet another embodiment relates to an all catalytic process for making medicinal grade white oils which comprises:

(a) hydrotreating a hydrocarbon feedstock under hydrotreating conditions to produce a hydrotreated feedstock;

(b) hydrocracking the hydrotreated feedstock under hydrocracking conditions to produce a hydrocracked feedstock, (c) separating ammonia and hydrogen sulfide contaminants from the hydrocracked feedstock, (d) dewaxing the hydrocracked feedstock from step (c) using a hydroisomerizing dewaxing catalyst under dewaxing conditions to produce a dewaxed feedstock, (e) separating light ends from the dewaxed feedstock, (f) hydrofinishing the dewaxed feedstock from step (e) under first hydrofinishing conditions to produce a first hydrofinished product, (g) fractionating the first hydrofinished product from step (f) to separate a first medicinal white oil and a base oil plus technical white oil, (h) hydrofinishing the first medicinal white oil from step (g) under second hydrofinishing conditions including MCM-41 as hydrofinishing catalyst to produce a hydrofinished medicinal white oil, and (i) adjusting conditions in at least one of step (a), step (b), step (d), step (f) or step (h) as required to produce a hydrofinished medicinal white oil that has a naphthenic carbon to paraffinic carbon ratio in the range 0.45 to 0.65.

A still further embodiment relates to an all catalytic process for making medicinal grade white oils which comprises:

(a) hydrotreating a hydrocarbon feedstock under hydrotreating conditions to produce a hydrotreated feedstock;

(b) hydrocracking the hydrotreated feedstock under hydrocracking conditions to produce a hydrocracked feedstock, (c) separating ammonia and hydrogen sulfide contaminants from the hydrocracked feedstock, (d) dewaxing the hydrocracked feedstock from step (c) using a hydroisomerizing dewaxing catalyst under dewaxing conditions to produce a dewaxed feedstock, (e) fractionating the dewaxed feedstock to separated light ends, a base oil plus technical white oil and a medicinal white oil, (f) hydrofinishing the base oil plus technical white oil from step (e) under hydrofinishing conditions to produce a first hydrofinished product, (g) hydrofinishing the medicinal white oil from step (e) under hydrofinishing conditions including MCM-41 as hydrofinishing catalyst to produce a hydrofinished medicinal white oil, and (h) adjusting conditions in at least one of step (a), step (b), step (d), or step (g) as required to produce a hydrofinished medicinal white oil that has a naphthenic carbon to paraffinic carbon ratio in the range 0.45 to 0.65.

DETAILED DESCRIPTION OF THE INVENTION

Figure 1:
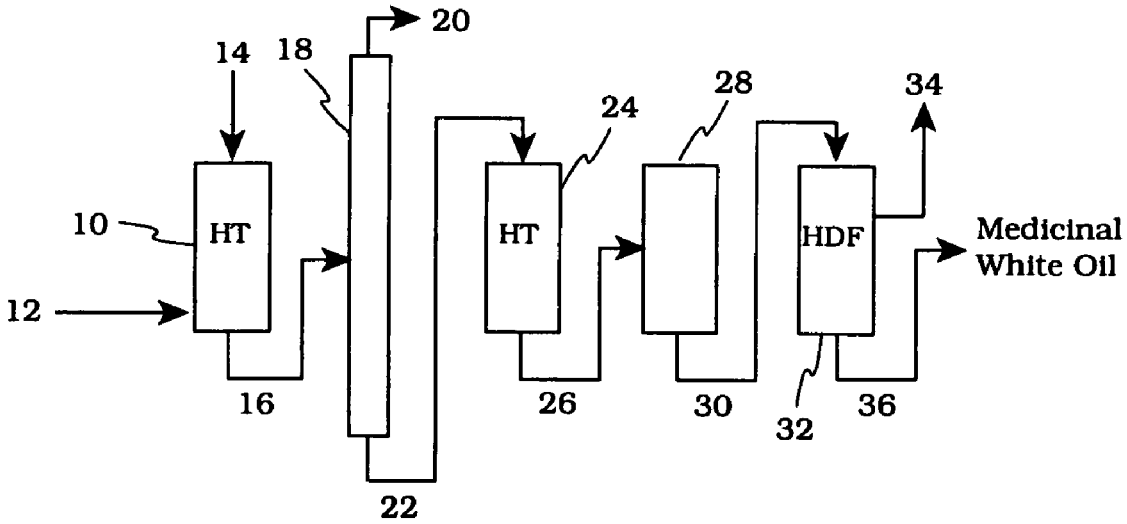
FIG. 1 is a schematic drawing of an embodiment of the process for producing a medicinal white oil.

The feedstocks suitable for use in the practice of the present process for the manufacture of medicinal white oils are crudes and petroleum hydrocarbon fractions capable of yielding a product of the desired properties by treatment in accordance with the present process steps. Feedstocks include whole crudes, especially naphthenic crudes and fractions thereof such as distillates, raffinates and the like.

The feedstock is first hydrotreated. Hydrotreating typically is employed to reduce the concentration of polars and aromatics in the feedstock. As such, hydrotreating encompasses hydrodesulfurization (HDS), hydrodenitrogenation (HDN) and hydrodearomatization (HDA). Hydrotreating will also at least partially remove oxygenates. Hydrotreating catalysts typically include at least one metal from Groups 6, 8, 9 and 10 of the Periodic Table based on the IUPAC format having groups 1-18. Preferred metals include Co, Mo, Ni, W, and Ru. Because hydrotreating catalysts are more active in their metal sulfide form, they are normally sulfided before use. In the case of HDS and HDN, preferred catalysts contain Co, Mo, Ni, W, and mixtures thereof, more preferably Co/Mo, Ni/Mo, and Ni/W, especially Co/Mo. These catalysts are usually supported on a refractory inorganic oxide support such as alumina, silica, silica-alumina and the like. HDS and HDN catalysts may also be bulk metal catalysts. Preferred bulk metal catalysts are comprised of at least one Group 8-10 non-noble metal and at least two Group 6 metals and wherein the ratio of Group 6 metal to Group 8-10 non-noble metal is from about 10:1 to about 1:10, and have the formula $(X)_b(Mo)_c(W)_dO_z$ wherein X is one or more Group 8-10 non-noble metals, and the molar ratio of b:(c+d) is 0.5/1 to 3/1. Such catalysts are described in U.S. Pat. No. 6,783,663 which is incorporated herein in its entirety. HDS and HDN process conditions include temperatures in the range 149° C. to 538° C. (300 to 1000° F.), pressures in the range 446 to 34576 kPa (50 to 5000 psig), hydrogen treat gas rate in the range of 17.8 to 1780 $m^3/m^3$ (100 to 10000 SCF/bbl) and a liquid hourly space velocity in the range 0.1 to 10 $hr^{-1}$. Selective HDN of heterocyclic aromatic compounds containing unsaturated nitrogen-containing rings may use catalysts containing Groups 8-9 noble metals and reaction modifiers.

In one embodiment, the hydrotreated feedstock is stripped of hydrogen sulfide and ammonia using conventional stripping techniques such as gas strippers and knock out drums. The stripped hydrotreated feedstock is then followed by a second hydrotreating using catalysts and process conditions as described above for the first hydrotreating step. The second hydrotreating step is run under process conditions that are similar to or milder than the process conditions of the first hydrotreating step. The purpose of the second hydrotreating step is to further reduce the concentration of polars, aromatics or both in the feedstock while minimizing boiling point conversion due to hydrocracking of the feedstock. In general, boiling point conversion for the subject hydrotreating steps is less than 20 wt % total, based on feedstock. Preferably, the boiling point conversion in each individual hydrotreating step is 15 wt % or less. The product from the second hydrotreating step may then be sent to a dewaxing zone.

(a) The hydrotreating reaction stage can be comprised of one or more fixed bed reactors or reaction zones each of which can comprise one or more catalyst beds of the hydroprocessing catalyst. Although other types of catalyst beds can be used, fixed beds are preferred. Such other types of catalyst beds include fluidized beds, ebullating beds, slurry beds, and moving beds. Interstage cooling or heating between reactors or reaction zones, or between catalyst beds in the same reactor or reaction zone, can be employed since the desulfurization reaction is generally exothermic. A portion of the heat generated during hydrotreating can be recovered. Where this heat recovery option is not available, conventional cooling may be performed through cooling utilities such as cooling water or air, or through use of a hydrogen quench stream. In this manner, optimum reaction temperatures can be more easily maintained. It is also within the scope of this invention to use other catalysts in the case of multiple catalyst beds. Such other catalysts may comprise conventional hydroprocessing catalysts.

In one embodiment, the hydrotreated feedstock may be hydrocracked under hydrocracking conditions to produce a hydrotreated and hydrocracked feedstock. Hydrocracking involves molecular weight reduction by cracking larger molecules into smaller ones. Hydrocracking typically involves a number of reactions such as cracking of large molecules, hydrogenation of olefinic bonds, ring opening, heteroatom removal and hydrogenation of aromatics. Hydrocracking catalysts include a cracking component, a hydrogenation component and a binder or support. The cracking component may be amorphous or crystalline. Amorphous cracking catalysts include silica-aluminas. Crystalline cracking catalysts are molecular sieves including aluminosilicates such as zeolites and aluminophosphates such as SAPOs. Examples of zeolites as cracking catalysts include Y, USY, X, beta, ReY, mordenite, faujasite, ZSM-12 and other large pore zeolites. Examples of SAPOs include SAPO-11, SAPO-31, SAPO-41, MAPO-11 and ELAPO-31. Hydrogenation components include Group 6 or Group 8-10 metals or oxides or sulfides thereof, preferably one or more of molybdenum, tungsten, cobalt, or nickel, Ru, or the sulfides or oxides thereof. The Groups are based on the IUPAC format of the Periodic Table having Groups 1-18. Examples of suitable refractory supports include refractory oxides such as alumina, silica-alumina, halogenated alumina, silica-magnesia, silica-zirconia, alumina-boria, silica-titania, silica-zirconia-titania, acid-treated clays, and the like. A preferred catalyst comprises (a) an amorphous, porous solid acid matrix, such as alumina, silica-alumina, silica-magnesia, silica-zirconia, silica-thoria, silica-beryllia, silica-titania, silica-alumina-rare earth and the like, and (b) a zeolite such as faujasite. The matrix can comprise ternary compositions, such as silica-alumina-thoria, silica-alumina-zirconia, magnesia and silica-magnesia-zirconia. Hydrocracking conditions include temperatures from 204 to 510° C., total pressures of from 790 to 34576 kPa (100 to 5000 psig), space velocities of from 0.1 to 10 $hr^{-1}$ and hydrogen treat gas rates from 17.8 to 1780 $m^3/m^3$ (100 to 10000 scf/B).

The hydrocracked product is then stripped of gases such as ammonia, hydrogen sulfide and light products in a stripping zone which may include a stripper such as a knock-out drum or a fractionator such as a distillation column. The bottoms from the column comprise a hydrocarbon fraction which may be sent to a dewaxer.

Hydrodewaxing of hydrocarbons concerns the removal of waxy components of hydrocarbon feedstocks using dewaxing catalysts. Hydrodewaxed feedstocks typically have improved properties including at least one of VI, viscosity, pour point and cloud point. By hydroisomerizing dewaxing catalyst is meant a dewaxing catalyst that dewaxes primarily by hydroisomerizing waxy components as compared to a dewaxing catalyst that dewaxes primarily by hydrocracking waxy components although no dewaxing catalyst operates by one mechanism to the exclusion of the other. Hydroisomerization of waxy components isomerizes the waxes to more highly branched molecules whereas hydrocracking cracks waxy molecules to smaller (lower molecular weight) molecules. Preferably, the dewaxing catalysts of the present process operate primarily by hydroisomerizing waxy components. By primarily is meant that the dewaxing mode by hydroisomerization is the predominant dewaxing mode, i.e., greater than 50% of the dewaxing is done by hydroisomerization, more preferably greater than 70%. Alternatively, a catalyst with a lower preference for hydroisomerization can be used, such as a ZSM-5 type catalyst. The dewaxing catalyst may be either crystalline or amorphous. Crystalline materials are molecular sieves that contain at least one 10 or 12 ring channel and may be based on aluminosilicates (zeolites), or may be based on aluminophosphates. Examples of suitable zeolites include ZSM-5, ZSM-12, ZSM-22, ZSM-23, ZSM-35, ZSM-48, ZSM-57, ferrierite, EU-1, NU-87, ITQ-13 and MCM-71. Examples of aluminophosphates containing at least one 10 ring channel include SAPO-11 and SAPO-41. Preferred isomerizing catalysts include ZSM-48, ZSM-22, ZSM-23, ZSM-12, and ZSM-35. More preferred isomerizing catalysts include ZSM-48, ZSM-22 and ZSM-23. Especially preferred is ZSM-48. As used herein, ZSM-48 includes EU-2, EU-11 and ZBM-30 which are structurally equivalent to ZSM-48. The molecular sieves are preferably in the hydrogen form. Reduction can occur in situ during the dewaxing step itself or can occur ex situ in another vessel.

Amorphous dewaxing catalysts include alumina, fluorided alumina, silica-alumina, fluorided silica-alumina and silica-alumina doped with Group 3 metals. Such catalysts are described for example in U.S. Pat. Nos. 4,900,707 and 6,383,366.

The dewaxing catalysts are bifunctional, i.e., they are loaded with a metal hydrogenation component, which is at least one Group 6 metal, at least one Group 8-10 metal, or mixtures thereof. Preferred metals are Groups 9-10 metals. These metals are loaded at the rate of 0.1 to 30 wt. %, based on catalyst. Catalyst preparation and metal loading methods are described for example in U.S. Pat. No. 6,294,077, and include for example ion exchange and impregnation using decomposable metal salts. Metal dispersion techniques and catalyst particle size control are described in U.S. Pat. No. 5,282,958. Catalysts with small particle size and well dispersed metal are preferred. The molecular sieves are typically composited with binder materials that are resistant to high temperatures and may be employed under dewaxing conditions to form a finished dewaxing catalyst or may be binderless (self-bound). The binder materials are usually inorganic oxides such as silica, alumina, silica-aluminas, binary combinations of silicas with other metal oxides such as titania, magnesia, thoria, zirconia and the like and tertiary combinations of these oxides such as silica-alumina-thoria and silica-alumina magnesia. The amount of molecular sieve in the finished dewaxing catalyst is from 10 to 100, preferably 35 to 100 wt. %, based on catalyst. Such catalysts are formed by methods such spray drying, extrusion and the like. The dewaxing catalyst may be used in the sulfided or unsulfided form, and is preferably in the sulfided form.

Dewaxing conditions include temperatures of from 200-500° C., preferably 250 to 350° C., pressures of from 790 to 20786 kPa (100 to 3000 psig), preferably 1480 to 17339 kPa (200 to 2500 psig), liquid hourly space velocities of from 0.1 to 10 $hr.^{-1}$, preferably 0.1 to 5 $hr^{-1}$ and hydrogen treat gas rates from 45 to 1780 $m^3/m^3$ (250 to 10000 scf/B), preferably 89 to 890 $m^3/m^3$ (500 to 5000 scf/B).

The dewaxed product from the dewaxer, with or without fractionation, is then conducted to a hydrofinishing zone. In one embodiment involving two hydrotreating steps, the dewaxed feedstock from the dewaxing zone is fractionated to separate hydrogen sulfide, ammonia and light ends from the dewaxed feedstock. The dewaxed feedstock is then hydrofinished. Any suitable hydrofinishing catalyst may be used, such as an amorphous substrate with a Group VI and/or a Group VIII metal. Alternatively, a zeolite can be included in the substrate, such as ZSM-48 or ZSM-35. Preferably, the hydrofinishing catalyst is a crystalline material belonging to the M41S class or family of catalysts. The M41S family of catalysts are mesoporous materials having high silica contents whose preparation is further described in J. Amer. Chem. Soc., 1992, 114, 10834. Examples included MCM-41, MCM-48 and MCM-50. Mesoporous refers to catalysts having pore sizes from 15 to 100 Å. A preferred member of this class is MCM-41 whose preparation is described in U.S. Pat. No. 5,098,684. MCM-41 is an inorganic, porous, non-layered phase having a hexagonal arrangement of uniformly-sized pores. The physical structure of MCM-41 is like a bundle of straws wherein the opening of the straws (the cell diameter of the pores) ranges from 15 to 100 Å. MCM-48 has a cubic symmetry and is described for example is U.S. Pat. No. 5,198,203 whereas MCM-50 has a lamellar structure. MCM-41 can be made with different size pore openings in the mesoporous range. The mesoporous materials may bear a metal hydrogenation component, which is at least one of Group 8, Group 9 or Group 10 metals.

In another embodiment, the dewaxed product from the dewaxer is sent without fractionation to a first stage hydrofinisher. In another embodiment, the dewaxed product from the dewaxed is sent to a fractionator separate light ends and then sent to a first stage hydrofinisher. Hydrofinishing catalysts in this stage are those containing Group 6 metals, Groups 8-10 metals, and mixtures thereof. In either stage, hydrofinishing catalysts may be in a single bed or may be in multiple beds. The multiple beds may be temperature staged. Preferred metals include at least one metal sulfide having a strong hydrogenation function. The mixture of metals may also be present as bulk metal catalysts wherein the amount of metal is 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals.

The hydrofinished product from the first stage hydrofinisher may then be sent to a second stage hydrofinisher with or without fractionating. A preferred hydrofinishing catalyst for the second stage hydrofinisher is a crystalline material belonging to the M41S class or family of catalysts. The M41S family of catalysts are mesoporous materials having high silica contents whose preparation and properties are described above. Examples included MCM-41, MCM-48 and MCM-50. A preferred member of this class is MCM-41.

If more than one hydrofinished stage is employed, the hydrofinishing process conditions are staged, i.e., hydrofinishing conditions in the second stage can be milder than those of the first stage, particularly as to temperature. Hydrofinishing conditions for the first hydrofinishing stage include temperatures from about 125-425° C., preferably 180-280° C., total pressures from 500-3000 psig, preferably 1500-2500 psig, liquid hourly space velocity from 0.1-5 LHSV ($hr^{-1}$), preferably 0.5-1.5 $hr^{-1}$ and hydrogen treat gas rates from 250-10000 scf/B, preferably 500-5000 scf/B. Similar conditions can be used for the second hydrofinishing stage. Preferably, one or more of the hydrofinishing conditions in the second hydrofinishing stage will be selected to have a lower value than the first hydrofinishing stage. For example, the temperature in the second stage can be from 10 to 50° C. lower than the first hydrofinishing stage.

In one embodiment, the product from the first hydrofinisher is sent to a separation zone. The separation zone includes fractionation to separate light products and gases from white oils. The white oils include a first white oil cut and a second white oil cut containing base oil. This first white oil cut is sent to a second hydrofinisher while the second white oil cut is a mixture of base oil and technical white oil.

The second stage hydrofinisher is dedicated to the production of medicinal white oils as the final product. The preferred hydrofinishing catalyst is a crystalline material belonging to the M41S class or family of catalysts as described hereinbefore. Especially preferred is MCM-41. The mesoporous materials may bear a metal hydrogenation component, which is at least one of Group 8, Group 9 or Group 10 metals. Particularly preferred is Pt, Pd or mixtures thereof. Hydrofinishing conditions in the second hydrofinisher can be selected from the same general ranges as in the first hydrofinisher.

In another embodiment, the dewaxed product from the dewaxer is sent to a separation zone. The separation zone includes distillation to separate light products and gases from white oils. The white oil cut is sent to a first hydrofinisher and hydrofinished using the catalyst and conditions set forth above. The product from the first hydrofinisher is the separated into a cut sent to the second hydrofinisher using a MCM-41 catalyst and hydrofinishing conditions to produce a medicinal white oil and a cut containing base oil and technical white oil.

Yet another embodiment involves the steps of sending the dewaxed product from the dewaxer is sent to a separation zone. The separation zone includes distillation to separate light products and gases from white oils. A first white oil cut is sent to a first hydrofinisher and hydrofinished using the catalyst and conditions set forth above. The product from the first hydrofinisher is a base oil plus technical white oil. A second cut from the separation zone is sent to the second hydrofinisher using a MCM-41 catalyst and hydrofinishing conditions to produce a medicinal white oil.

The medicinal white oil after hydrofinishing is the analyzed to determine its naphthenic and paraffinic carbon contents. This may be accomplished using gas chromatographic techniques or by gas chromatography coupled with mass spectrometry. The values for $C_n$ (naphthenic carbon) and $C_p$ (paraffinic carbon) are determined according to ASTM D-2140.

Once the $C_p$ and $C_n$ values for the medicinal oil product has been determined, the ratio of $C_n$:$C_p$ is obtained. The ratio should be between 0.45 to 0.65. If the $C_n$:$C_p$ ratio is outside the range of 0.45 to 0.65, then one may adjust either the $C_n$ or the $C_p$ by modifying the nature of the feedstock or by modifying reaction conditions in at least one of the hydrotreating, hydrocracking, dewaxing or hydrofinishing steps.

One method of controlling the $C_n$:$C_p$ ratio is to control the naphthenic content of the feedstock. This may be accomplished by appropriate blending of a naphthenic feedstock with other feedstocks.

Process modifications to adjust the $C_n$:$C_p$ ratio may be a function of the correction required. If relatively minor correction is needed, then one may adjust conditions in the hydrofinishing step. If higher saturates content (greater $C_p$) is desired, then the skilled operator may increase the hydrogen pressure, increase the temperature in the hydrofinisher or both. Alternatively, lower the pressure and/or temperature should lower the $C_p$ content.

The hydrotreating step may be used to adjust the $C_n$:$C_p$ ratio. In general, by raising the temperature and/or pressure of the hydrotreating reaction, one may raise the $C_n$:$C_p$ ratio.

If a hydrocracking step is employed, then increasing the severity of the hydrocracking conditions by increasing the temperature will lower the $C_n$:$C_p$ ratio. One may also increase the acidity of the hydrocracking catalyst or increase the pressure to lower the $C_n$:$C_p$ ratio.

The process of the invention is further described in the following figures. FIG. 1 is a schematic flow diagram of a preferred process scheme for the catalytic production of medicinal white oil. A feedstock is fed to hydrotreater 10 through line 12. The feedstock is hydrotreated under hydrotreating conditions. Hydrogen or hydrogen containing gas is added to hydrotreater 10 through line 14. The hydrotreated feedstock exits hydrotreater 10 through line 16 where it is conducted to fractionating column 18. Light ends, especially hydrogen sulfide and ammonia are removed through line 20. The hydrotreated product is then conducted through line 22 to a second hydrotreater 24 where it is hydrotreated under hydrotreating conditions that may be the same or different from the hydrotreating conditions in hydrotreated 10. Product from hydrotreater 24 is conducted to dewaxing unit 28 through line 26 where it is dewaxed under dewaxing conditions. The dewaxing catalyst is preferably ZSM-48. Additional hydrogen or hydrogen containing gas may be added to 28. Dewaxed product exits dewaxing unit 28 through line 30 and is conducted without disengagement to a hydrofinisher 32 where it is hydrofinished under hydrofinishing conditions. The hydrofinishing catalyst is preferably MCM-41. A sample of hydrofinished product from 32 is withdrawn through line 34 and is analyzed for $C_n$:$C_p$ ratio. If necessary, product from line 34 may be conducted to at least one of units 12, 24, 28 or 32 to correct the $C_n$:$C_p$ ratio. When the desired $C_n$:$C_p$ ratio is attained, i.e., a range from 0.45 to 0.65, medicinal white product may be withdrawn through line 36.

Figure 2:
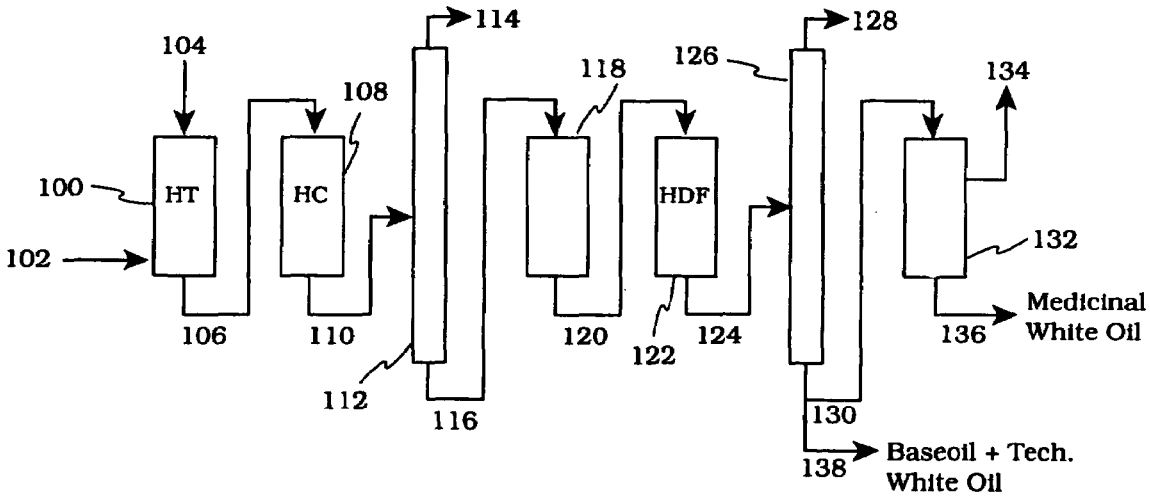
FIG. 2 is a schematic drawing of another embodiment of the process for producing a medicinal white oil.

FIG. 2 is a schematic flow diagram of another embodiment of a process scheme for the catalytic production of medicinal white oil. A feedstock is fed through line 102 to hydrotreater 100. The feedstock is hydrotreated under hydrotreating conditions. Hydrogen or hydrogen containing gas is added to hydrotreater 100 through line 104. The hydrotreated feedstock exits hydrotreater 100 through line 106 where it is conducted to hydrocracker 108 without disengagement. The hydrotreated product is hydrocracked under hydrocracking conditions and product from hydrocracker 108 is conducted through line 110 to fractionator 112. Gases such as ammonia, hydrogen sulfide, hydrogen treat gas and light hydrocarbons exit 112 through line 114. Hydrogen treat gas may be isolated and recycled for further use. Liquid product exits through line 116 and is conducted to catalytic dewaxer (CDW) 118 preferably containing ZSM-48 as catalyst where it is dewaxed under dewaxing conditions. Additional hydrogen or hydrogen containing gas may be added to CDW 118. Dewaxed product exits CDW 118 through line 120 and is conducted to a first hydrofinisher 122 where it is hydrofinished under hydrofinishing conditions. Hydrofinisher 122 also serves as a guard bed against The hydrofinished product from 122 is conducted through line 124 to a fractionator 126. The fractionated product from 126 includes a first medicinal white oil and a base oil plus technical white oil. The first medicinal white oil is conducted through line 130 to a second hydrofinisher 132 preferably containing a noble metal supported on MCM-41 as catalyst. A sample of hydrofinished product from 132 is withdrawn through line 134 and is analyzed for $C_n$:$C_p$ ratio. If necessary, product from line 134 may be conducted to at least one of units 102, 108, 118 or 132 to correct the $C_n$:$C_p$ ratio. When the desired $C_n$:$C_p$ ratio is attained, i.e., a range from 0.45 to 0.65, medicinal white product may be withdrawn through line 136. A base oil plus technical white oil is withdrawn from fractionator 126 and sent for further processing through line 138.

Figure 3:
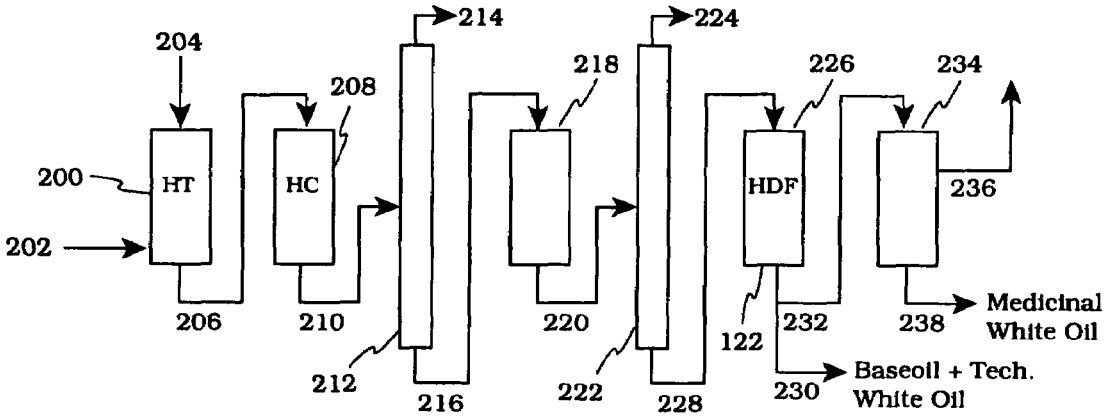
FIG. 3 is a schematic drawing of another embodiment of the process for producing a medicinal white oil.

FIG. 3 is a schematic flow diagram of yet another embodiment of a process scheme for the catalytic production of medicinal white oil. A feedstock is fed through line 202 to hydrotreater 200. The feedstock is hydrotreated under hydrotreating conditions. Hydrogen or hydrogen containing gas is added to hydrotreater 200 through line 204. The hydrotreated feedstock exits hydrotreater 200 through line 206 where it is conducted to hydrocracker 208 without disengagement. The hydrotreated product is hydrocracked under hydrocracking conditions and product from hydrocracker 208 is conducted through line 210 to fractionator 212. Gases such as ammonia, hydrogen sulfide, hydrogen treat gas and light hydrocarbons exit 212 through line 214. Hydrogen treat gas may be isolated and recycled for further use. Liquid product exits through line 216 and is conducted to catalytic dewaxer (CDW) 218 preferably containing ZSM-48 as catalyst where it is dewaxed under dewaxing conditions. Additional hydrogen or hydrogen containing gas may be added to CDW 218. Dewaxed product from the CDW is conducted to fractionator 222 through line 220 where ammonia, hydrogen sulfide and light ends are separated and exit fractionator 222 through line 224. Liquid product from fractionator 222 is conducted to a first hydrofinisher 226 line 228 where it is hydrofinished under hydrofinishing conditions. Product from hydrofinisher 226 is separated in a fractionator (not shown) into a first medicinal white oil and a base oil plus technical white oil. The base oil and technical white oil are withdrawn through line 230. First medicinal white oil is conducted through line 232 to a second hydrofinisher 234 preferably containing MCM-41 as hydrofinishing catalyst. A sample of hydrofinished product from 234 is withdrawn through line 236 and is analyzed for $C_n$:$C_p$ ratio. If necessary, product from line 236 may be conducted to at least one of units 202, 208, 218 or 234 to correct the $C_n$:$C_p$ ratio. When the desired $C_n$:$C_p$ ratio is attained, i.e., a range from 0.45 to 0.65, medicinal white product may be withdrawn through line 238.

Figure 4:
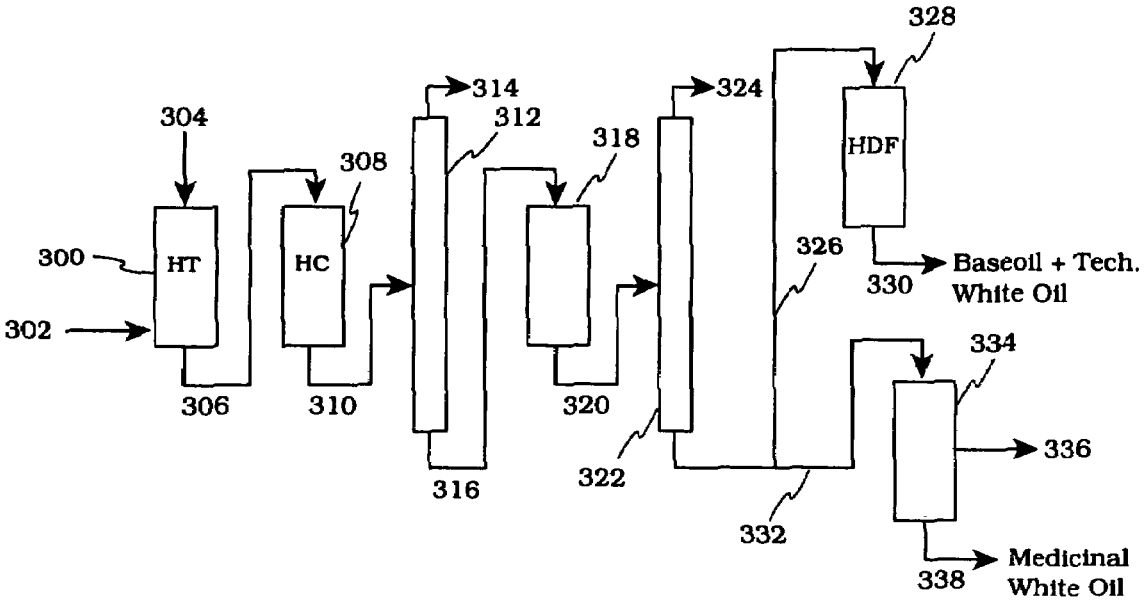
FIG. 4 is a schematic drawing of another embodiment of the process for producing a medicinal white oil.

FIG. 4 is a schematic flow diagram of another embodiment of a process scheme for the catalytic production of medicinal white oil. A feedstock is fed through line 302 to hydrotreater 300. The feedstock is hydrotreated under hydrotreating conditions. Hydrogen or hydrogen containing gas is added to hydrotreater 300 through line 304. The hydrotreated feedstock exits hydrotreater 300 through line 306 where it is conducted to hydrocracker 308 without disengagement. The hydrotreated product is hydrocracked under hydrocracking conditions and product from hydrocracker 308 is conducted through line 310 to fractionator 312. Gases such as ammonia, hydrogen sulfide, hydrogen treat gas and light hydrocarbons exit 312 through line 314. Hydrogen treat gas may be isolated and recycled for further use. Liquid product exits through line 316 and is conducted to catalytic dewaxer (CDW) 318 preferably containing ZSM-48 as catalyst where it is dewaxed under dewaxing conditions. Additional hydrogen or hydrogen containing gas may be added to CDW 318. Dewaxed product from the CDW is conducted to fractionator 322 through line 320 where ammonia, hydrogen sulfide and light ends are separated and exit fractionator 322 through line 324. Liquid product from fractionator 322 is separated into a base oil plus technical white oil and a first medicinal white oil. The base oil plus technical white oil is conducted through line 326 to hydrofinisher 328 where it is hydrofinished under hydrofinishing conditions. The hydrofinished base oil plus technical white oil is then conducted through line 330 to further processing. The first medicinal white oil is conducted through line 332 to a second hydrofinishing unit 334 preferably containing MCM-41 as hydrofinishing catalyst. A sample of hydrofinished product from 334 is withdrawn through line 336 and is analyzed for $C_n$:$C_p$ ratio. If necessary, product from line 336 may be conducted to at least one of units 302, 308, 318 or 334 to correct the $C_n$:$C_p$ ratio. When the desired $C_n$:$C_p$ ratio is attained, i.e., a range from 0.45 to 0.65, medicinal white product may be withdrawn through line 338.

Medicinal white oils are highly refined oils that are required to have certain properties. These include a Saybolt color of +30 by ASTM D156-02, color stability (low UV absorbances) in accordance with 21 CFR 178.3620, pour point and volatility. An important property for medicinal oils is the aromatics content as measured by the Hot Acid Test by ASTM D-565. Standards for the properties of medicinal white oils are described in US published application 20040014877. These include the European Pharmacopeia, 3rd edition, U.S. Pharmacopeia, 23rd edition, US FDA specification for direct food use, 21 CFR 172.927 and 21 CFR 178.3620 for indirect food use.

The invention is further illustrated in the following examples. The examples are for purposes of illustration and are not limiting.

EXAMPLE 1

This example demonstrates a process for producing a white oil, including a hydrotreating step, a hydrodewaxing step, and a hydrofinishing step. The process described below produced a product that approached white oil specifications and met a Cn/Cp ratio of 0.45 with 31% naphthenic carbon and 69% paraffinic carbon. The hydrotreating catalyst was a commercially available NiMo catalyst, the hydrodewaxing catalyst was a Pt/ZSM-48 catalyst, and the hydrofinishing step used a catalyst including an MCM-41 support and a combination of Pt and Pd.

The initial feed to the hydrotreater was a raffinate feed with a S content of 8462 ppm and a N content of 161 ppm. The density of the raffinate feed was 0.8829, and the 90% boiling point of the feed was about 550° C. The feed was hydrotreated at 370° C. at a total pressure of 400 psig, an LHSV of 1, and an $H_2$ feed rate of 550 scf/B. The resulting hydrotreated raffinate had an S content of 99 ppm, an N content of about 14, and a 90% boiling point of about 540° C.

The hydrotreated raffinate was then hydrodewaxed at 355° C. at a total pressure of 1850 psig, an LHSV of 0.75, and an $H_2$ feed rate of 1000 scf/B. The resulting product had an S content of about 6 ppm, an N content of about 1 ppm, and a 90% boiling point of about 538° C. This hydrodewaxed product was then distilled to remove the fraction boiling below 482° C.

The distilled 482+° C. product was then hydrofinished at 240° C. at a total pressure of 2100 psig, an LHSV of 0.84, and an $H_2$ feed rate of 1200 scf/B. The resulting product had an S content of about 6 ppm, an N content of about 1 ppm, and a 90% boiling point of about 558° C.

EXAMPLE 2

This example demonstrates the impact of hydrofinishing temperature staging on product quality. This example was performed using a severely hydrotreated, to less than 10 wppm sulfur, 600N raffinate. This feed is intended to represent the type of processed hydrocarbon that would exit the hydroisomerization steps and be passed on to the hydrofinishing steps. High coloration (Saybolt<−40) and low saturates content (<70%) resulted from the higher temperature used to prepare this feedstock. The feedstock was processed over a Pt/Pd on MCM-41 supported hydrogenation catalyst operating at 1800 and 1200 psig hydrogen pressure.

Figure 5:
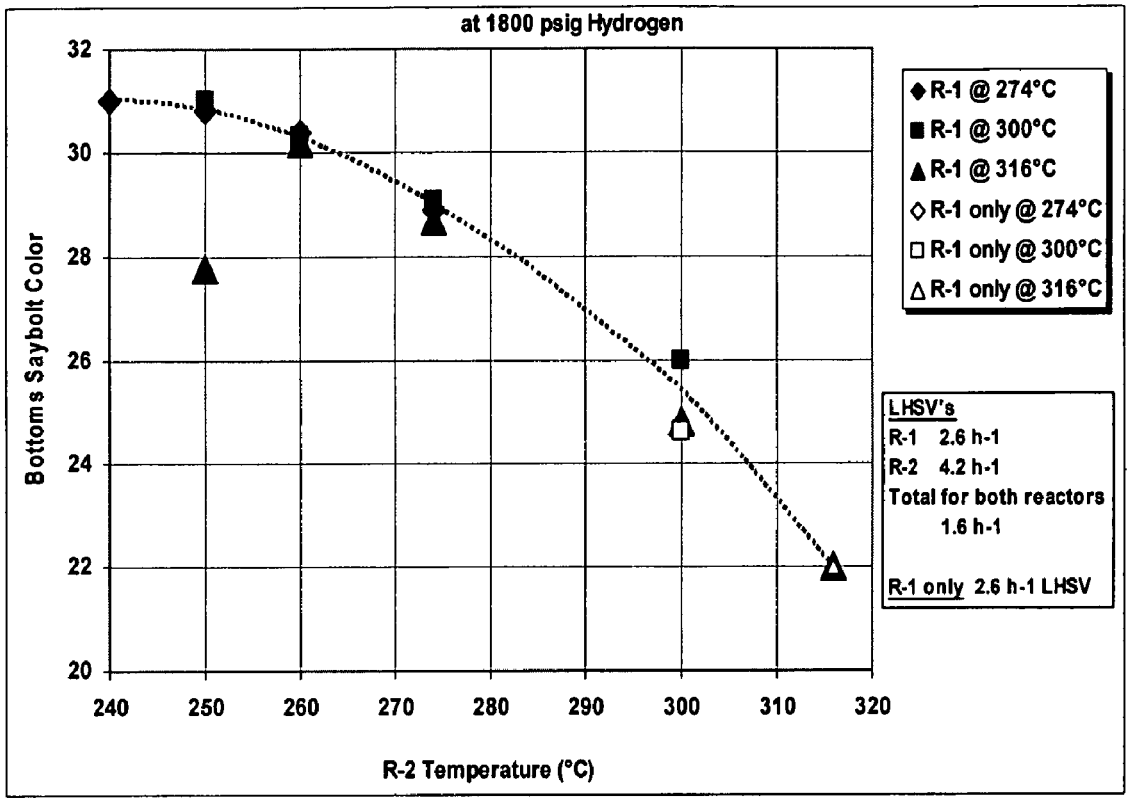
FIGS. 5-8 provide data related to various hydrofinishing conditions suitable for producing white oils.
Figure 6:
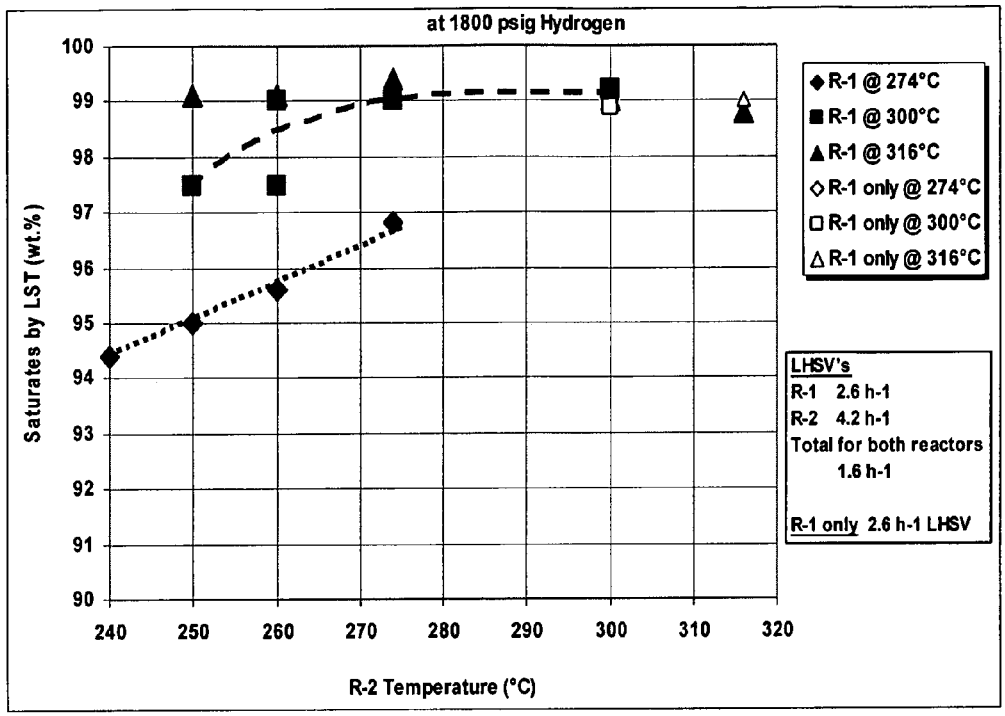
Figure 7:
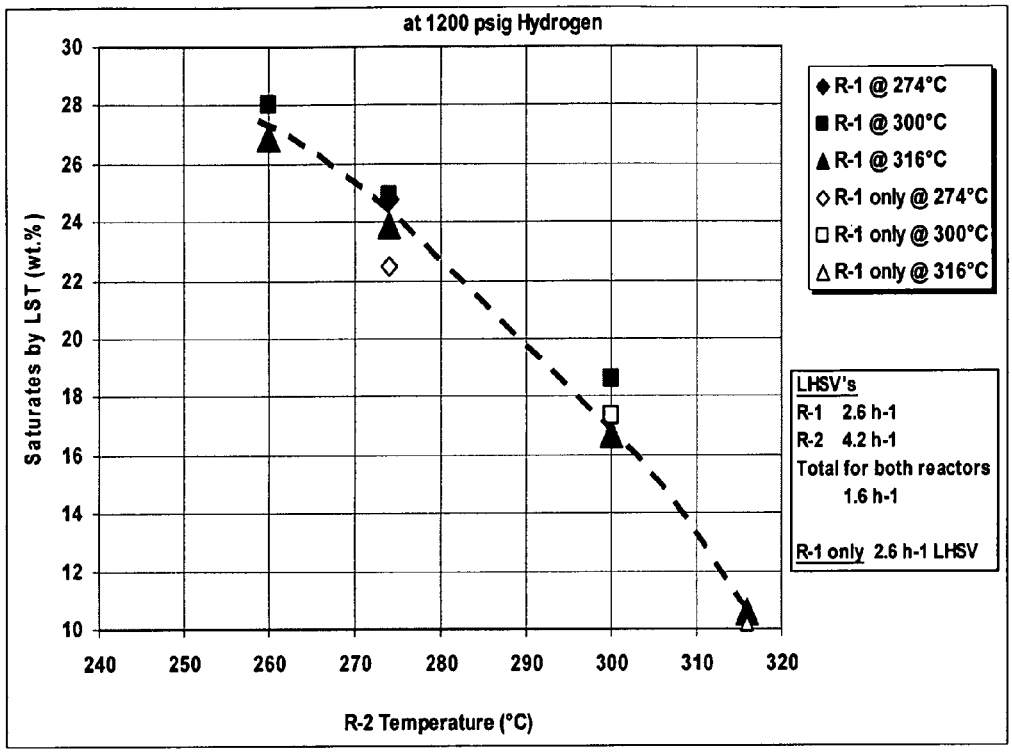
Figure 8:
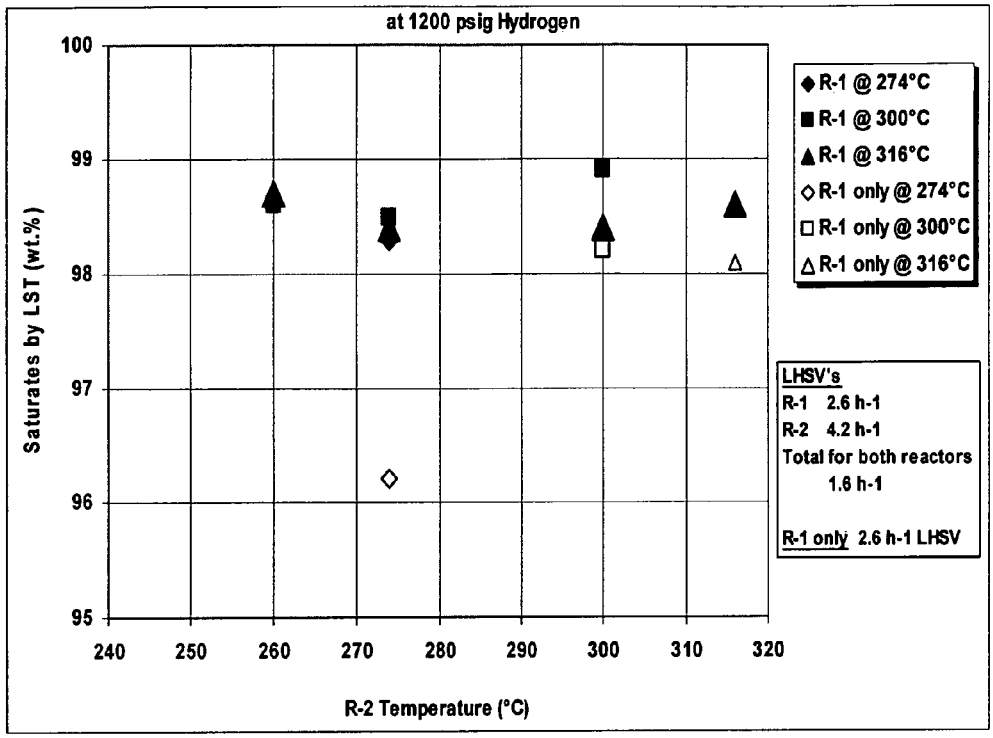

FIG. 5 shows the Saybolt color for a hydrofinished product after 1 or 2 stages of hydrofinishing at 1800 psig. The solid symbols in FIG. 5 represent 2 stage processes, while the open symbols represent single stage (and therefore single temperature) processes. FIG. 5 shows that single stage processes do not achieve the desired target of a Saybolt color of greater than 30. Using a two stage process, however, allows the second stage hydrofinishing to be conducted at a lower temperature. The second, lower temperature hydrofinishing stage provides a product with a Saybolt color either closer to or better than the target of 30. FIG. 6 shows the saturates for the hydrofinished products from FIG. 5. This shows that for processes where the first stage is conducted at 274° C., the level of saturation is reduced relative to higher hydrofinishing temperatures. FIGS. 7 and 8 show similar types of data for hydrofinishing processes conducted at 1200 psig.

The data reported in FIGS. 5-8 clearly show a product quality advantage when operating in a staged-temperature mode. The data demonstrates that high saturates product can be obtained when operating the first bed operating at higher temperature. While the product effluent from the first bed has a high saturates content, its color is less than 30 Saybolt at 316° C. and 300° C. The lower color can however be easily corrected by operating the second bed at a lower temperature. Furthermore, the second bed was operated at a higher LHSV (4.2 $h^{-1}$) indicating that the reaction correcting the color is very rapid.

EXAMPLE 3

The data in Table 3 is from an all catalytic system to produce technical white oils. The data in Table 3 was generated from a system having a configuration similar to the configuration shown in FIG. 1.

TABLE 3

| | |
|---|---|
| Total feed (100% MVGO), kBSD | 12.1 |
| Feed Quality | |
| API | 20.2 |
| S, wt % | 2.87 |
| N, wppm | 818 |
| SDW VI @ −12 C. PP | 55.2 |
| kV@100 C., cSt | 7.171 |
| Total Aromatics (TA), mmol/kg | 1328.7 |
| LHDC Operating Conditions | |
| Demet, ABT, C. | 365 |
| HDT ABT, C. | 373 |

TABLE 3-continued

| | |
|---|---|
| HDC ABT, C. | 357 |
| LHDC Product Quality | |
| Yield, % | 75.4 |
| API | 32.2 |
| S, wppm | 3-4 |
| N, wppm | <1 |
| SDW VI @ 12 C. PP | 102-103 |
| kV@100 C., cSt | 5.30 |
| TA, mmol/kg | 61.735 |
| 2 + R Aromatics, mmol/kg | 7.8196 |
| 3 + R Aromatics, mmol/kg | 1.9896 |
| Total Feed (100% LHDC Btm), kBSD | 9.6 |
| Operating Conditions | |
| Pretreat ABT, C | 334 |
| HDW ABT, C | 314 |
| HDF ABT, C | 220/215/213 |
| Product Quality | TPE WO |
| Yield, wt % | 78.1 |
| Simdist 375 C. recovery, wt % | 8.5 |
| Density@15 C., g/cc | 0.8613 |
| RI@20 C. | 1.4722 |
| kV@40 C., cSt | 36.7 |
| kV@100 C., cSt | 6.03 |
| VI | 109 |
| Pour Point, C. | −18 |
| TA, mmol/kg | −1.7307 |
| 2 + R Aromatics, mmol/kg | −5.2886 |
| 3 + R Aromatics, mmol/kg | −1.0184 |
| Saybolt Color | +30 |
| UV Abs. @ 280-289 nm | <0.5 |
| UV Abs. @ 290-299 nm | <0.5 |
| UV Abs. @ 300-329 nm | <0.5 |
| UV Abs. @ 330-350 nm | <0.5 |
| % Cp | 66.05 |
| % Cn | 33.95 |
| % Ca | 0 |

What is claimed is:

1. An all catalytic process for making white oils comprising:

(a) hydrotreating a hydrocarbon feedstock under hydrotreating conditions to produce a first hydrotreated feedstock;

(b) separating ammonia and hydrogen sulfide from the first hydrotreated feedstock;

(c) hydrotreating stripped hydrotreated feedstock from step (b) under hydrotreating conditions to produce a second hydrotreated feedstock;

(d) dewaxing the second hydrotreated feedstock from step (c) using a hydroisomerizing dewaxing catalyst under dewaxing conditions to produce a dewaxed feedstock;

(e) fractionating the dewaxed product from step (d) to separate any ammonia, hydrogen sulfide and light ends from the dewaxed feedstock; and (f) hydrofinishing the dewaxed feedstock from step (e) under first hydrofinishing conditions to produce a first hydrofinished product, and (g) hydrofinishing the hydrofinished product from step (f) under second hydrofinishing conditions to produce a white oil product, wherein the temperature in said first hydrofinishing conditions is greater than the temperature in said second hydrofinishing conditions by at least 10° C.

2. The method of claim 1, wherein the catalyst used in at least one of step (f) or step (g) comprises a Group VIII noble metal supported on a support from the M41S family.

3. The method of claim 2, wherein the support from the M41S family is MCM-41.

4. The method of claim 1, wherein the hydroisomerizing dewaxing catalyst is ZSM-22, ZSM-23, ZSM-48, ZSM-12, or ZSM-35.

* * * * *